US006250099B1

(12) United States Patent
Furuya et al.

(10) Patent No.: US 6,250,099 B1
(45) Date of Patent: Jun. 26, 2001

(54) REFRIGERATING DEVICE

(75) Inventors: Shunichi Furuya; Hiroshi Kanai, both of Higashimatsuyama (JP)

(73) Assignee: Zexel Corporation, Tokyo (JP)

( * ) Notice: Subject to any disclaimer, the term of this patent is extended or adjusted under 35 U.S.C. 154(b) by 0 days.

(21) Appl. No.: 09/349,942

(22) Filed: Jul. 8, 1999

(30) Foreign Application Priority Data

Jul. 31, 1998 (JP) ..... 10-217451

(51) Int. Cl.[7] ..... E25B 43/02
(52) U.S. Cl. ..... 62/473
(58) Field of Search ..... 62/470, 473, 509

(56) References Cited

U.S. PATENT DOCUMENTS

| | | | | |
|---|---|---|---|---|
| 3,201,949 | * | 8/1965 | Kocher | 62/473 |
| 3,494,146 | * | 2/1970 | Valbjorn | 62/473 |
| 3,768,273 | * | 10/1973 | Missimer | 62/473 |
| 3,850,009 | * | 11/1974 | Villadsen | 62/473 |
| 4,282,717 | | 8/1981 | Bonar, II | 62/84 |
| 5,704,215 | * | 1/1998 | Lord et al. | 62/473 |
| 5,724,832 | | 3/1998 | Little et al. | 62/613 |

FOREIGN PATENT DOCUMENTS

| | | | | |
|---|---|---|---|---|
| 843 093 | | 5/1952 | (DE) . | |
| 0 837 291 | | 4/1998 | (EP) . | |
| 2143019 | * | 1/1985 | (GB) | 62/473 |

* cited by examiner

*Primary Examiner*—William E. Tapolcal
(74) *Attorney, Agent, or Firm*—Wenderoth, Lind & Ponack, L.L.P.

(57) ABSTRACT

In order to achieve an improvement in the efficiency of a refrigerating cycle and achieve quick and precise response to changes in the environment or the operating state while using carbon dioxide as a coolant, the refrigerating cycle according to the present invention is provided with a first expander and a second expander and further with a vapor-liquid separator provided between the first and second expanders. The components are arranged such that pressure of a vapor-phase coolant at high pressure, compressed by a compressor and cooled by a radiator, is reduced to an intermediate pressure level in a vapor-liquid two-phase range by the first expander. Then the coolant in a condition of a vapor-liquid mix is separated into a vapor-phase coolant by the vapor-liquid separator, so that only the liquid-phase coolant is expanded by the second expander, so that the vapor-phase coolant is taken into the intake side of the compressor while maintaining the intermediate pressure level. Therefore, no unnecessary energy is expended for compressing the vapor-phase coolant, and as a result, efficiency of the cycle may be improved.

23 Claims, 5 Drawing Sheets

REFRIGERATING DEVICE

BACKGROUND

The present invention relates to a supercritical refrigerating cycle that utilizes carbon dioxide as a coolant.

An example of a refrigerating cycle utilizing carbon dioxide ($CO_2$) as a coolant, which is disclosed in Japanese Examined Patent Publication No. H 7-18602, comprises a compressor, a radiator, a counter-flow heat exchanger, a means for expansion, an evaporator, an accumulator and the like.

In this structure, coolant is compressed by the compressor to be a vapor-phase coolant with a high pressure, and then it is cooled at the radiator to reduce its enthalpy. During this process, since the high-pressure vapor-phase coolant is at a temperature equal to or higher than a supercritical temperature (in a supercritical range) of the coolant, it is not condensed and does not become a liquid phase state at the radiator. In this point, the refrigerating cycle is different from prior refrigerating cycles employing Freon. Then, the high pressure coolant with the reduced enthalpy travels through the expansion valve so that its pressure is reduced down to a vapor-liquid mix range, and thus, the liquid-phase component is increased for the first time in the coolant in this stage. Subsequently, the liquid-phase component in the coolant absorbs heat of a medium traveling through the evaporator to be evaporated and then it is taken into the compressor.

In the refrigerating cycle described above, the counter-flow heat exchanger achieves heat exchange between the low temperature vapor-phase coolant taken into the compressor and the high-pressure vapor-phase coolant after passing through the radiator, and since the low pressure vapor-phase coolant is heated and at the same time the high-pressure vapor-phase coolant is cooled at the counter-flow heat exchanger, the efficiency of the refrigerating cycle is improved.

However, as it is a known fact that there is an optimal heat exchanging capacity in a refrigerating cycle employing a counter-flow heat exchanger depending upon the environment in which it is operated or the operating state. It is another known fact that if the environment or the operating state changes, the optimal heat exchanging capacity also changes, and therefore the optimal heat exchanging capacity must be adjusted in order to achieve improved efficiency under varying conditions. However, if the optimal heat exchanging capacity is changed, a problem arises such that the degree of superheat of the coolant in an intake side of the compressor becomes excessive, resulting in a high discharge temperature.

The temperature of the air entering the radiator changes constantly (due to changes in the external air temperature, during idling or high speed operation and the like). Furthermore, the force to drive the compressor is derived from the running engine so that the rotating state of the compressor changes in conformance to the running state. As such, when a refrigerating cycle as described above is employed in an air conditioning system for vehicles, problems arise because the environment or the operating state changes frequently.

SUMMARY OF THE INVENTION

Accordingly, an object of the present invention is to provide a refrigerating cycle that utilizes carbon dioxide as a coolant to achieve an improvement in the efficiency of the refrigerating cycle and to respond quickly and precisely to changes in the environment or the operating state.

In order to achieve the object described above, the refrigerating cycle according to the present invention, which comprises, at least, a compressor for compressing a vapor-phase coolant to a supercritical range, a radiator for radiating heat from the vapor-phase coolant in the supercritical range discharged from the compressor, a means for expansion for lowering pressure of the vapor-phase coolant in the supercritical range after passing through the radiator down to a vapor-liquid two-phase range and an evaporator for evaporating a liquid-phase component in the coolant with pressure reduced by the means for expansion, characterized in that the means for expansion is constituted of a first means for expansion and a second means for expansion, that a means for vapor-liquid separation is provided between the first means for expansion and the second means for expansion to separate the coolant with pressure reduced to the vapor-liquid two-phase range by the first means for expansion into a vapor-phase coolant to be returned to the compressor and a liquid-phase coolant to be delivered to the second means for expansion, and that a means for oil separation is provided on an upstream side of the second means for expansion to separate oil from the coolant and return the separated oil to the compressor.

Thus, according to the present invention, because the first and second means for expansion are provided and the means for vapor-liquid separation is provided between the first and second means for expansion, the pressure of the high-pressure vapor-phase coolant compressed by the compressor and cooled by the radiator is reduced to an intermediate pressure and the vapor-liquid two-phase range by the first means for expansion, the coolant with a vapor-liquid mix substance is separated into a vapor-phase coolant and a liquid-phase coolant by the means for vapor-liquid separation, only the liquid-phase coolant is expanded by the second means for expansion and the vapor-phase coolant is taken into the intake side of the compressor while maintaining the intermediate pressure, so that unnecessary energy for compressing the vapor-phase coolant may be controlled to achieve an improvement in the cycle efficiency.

In addition, because the means for oil separation is provided on the upstream side of the second means for expansion to separate the oil component from the liquid-phase coolant traveling to the second means for expansion and the evaporator, any reduction in the heat exchanging capability attributable to oil adhering in coolant passages in the evaporator can be prevented. Furthermore, since the separated oil at a low temperature is directly returned to the drive portion of the compressor, the efficiency of the compressor may be improved.

Moreover, in the present invention, it is preferred that a threephase phase separator integrating the means for oil separation and the means for vapor-liquid separation is provided between the first means for expansion and the second means for expansion. Thus, the structure of the refrigerating cycle may be simplified.

In addition, in the present invention, it is desirable that the means for oil separation is provided on the upstream side of the first means for expansion. Thus, the first means for expansion c an reduce the pressure of only the pure coolant from which oil is separated to assure a reduction in the pressure of the coolant to the vapor-liquid mix range with a high degree of reliability.

Alternatively, in the present invention, it is preferred that a three-phase separator integrating the means for oil separation, the means for vapor-liquid separation and a first means for expansion communicating between the means for oil separation and the means for vapor-liquid separation is provided between the radiator and the second means for expansion. Thus, the structure of the refrigerating cycle may be simplified.

In addition, in the present invention, it is desirable that the means for oil separation is provided on the upstream side of the radiator. Since carbon dioxide utilized as the coolant remains in the vapor phase state until it reaches the first means for expansion, oil solubility to the coolant is low, so that the oil adheres to the passage walls in the radiator and it causes reduction in the heat exchanging capability, as a result, it is desirable that the means for oil separation is provided on the upstream side of the radiator.

Furthermore, in the present invention, it is desirable that the first means for expansion is an orifice tube and the s econd means for expansion is an automatic expansion valve which is controlled so as to maintain a degree of superheat thereof constantly. Alternatively, the first means for expansion may be an automatic expansion valve which is controlled so as to maintain a degree of superheat thereof constantly, and the second means for expansion may be an orifice tube. As a further alternative, the first means for expansion may be an electrically-controlled expansion valve which is controlled by an external signal and the second means for expansion may be an automatic expansion valve which is controlled so as to maintain a degree of superheat thereof. Or, both the first and second means for expansion may comprise an electrically-controlled expansion valve which is controlled by an external signal.

Thus, since the refrigerating cycle is controlled to maintain a degree of superheat in the outlet side of the evaporator, it can respond to abrupt changes in the load attributable to external factors such as the environment or the operating state. In addition, since intermediate pressure control is executed by the first means for expansion, finer control of the refrigerating cycle is achieved.

BRIEF DESCRIPTION OF THE DRAWINGS

Further objects and advantages of the invention can be more fully understood from the following detailed description given in conjunction with the accompanying drawings in which.

DESCRIPTION OF THE PREFERRED EMBODIMENTS

The following is an explanation of the preferred embodiments of the present invention given in reference to the drawings.

Figure 1:
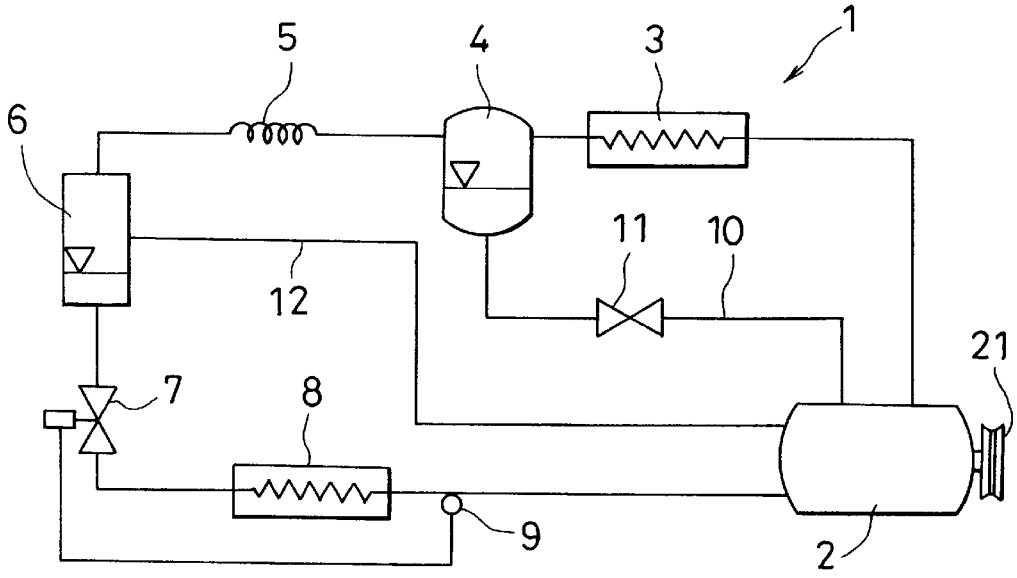
FIG. 1 is a schematic block diagram of the refrigerating cycle in a first embodiment of the present invention.

A refrigerating cycle 1 in the first embodiment of the present invention illustrated in FIG. 1 utilizes carbon dioxide as its coolant and comprises a compressor 2 interlocked with a running engine (not shown) via a pulley 21, a radiator 3 cooling the coolant discharged from the compressor 2, an oil separator 4 provided on a downstream side of the radiator 3, an orifice tube 5 as a first means for expansion provided on a downstream side of the oil separator 4, a vapor-liquid separator 6 connected to a downstream side of the orifice tube 5, an automatic expansion valve 7 as a second means for expansion to which a liquid-phase coolant separated by the vapor-liquid separator 6 is supplied and an evaporator 8 provided on the downstream side of the automatic expansion valve 7.

Figure 9:
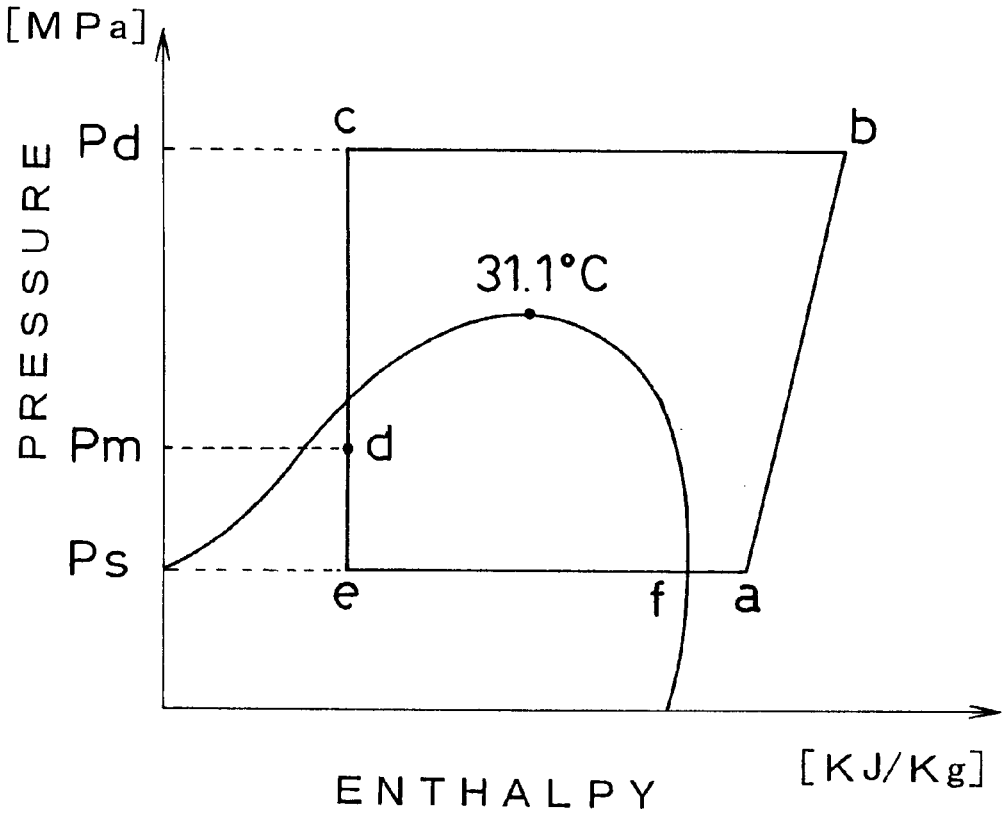
FIG. 9 is a Mollier chart achieved by utilizing carbon dioxide for a coolant.

In the refrigerating cycle 1 in the first embodiment, a vapor-phase coolant at low pressure Ps taken into the compressor 2 is first compressed by the compressor 2 to achieve a pressure Pd in the supercritical range for the coolant at the compressor 2 (a–b in the Mollier chart in FIG.9). Then, the vapor-phase coolant at the high pressure Pd is cooled by the radiator 3 to radiate heat of the coolant into the air passing through the radiator (b–c). The vapor-phase coolant cooled by the radiator 3 is sent to the oil separator 4 where the oil dissolved in the coolant or carried by the coolant is separated. The oil thus separated is returned to a drive portion of the compressor 2, i.e., a seal portion between a shaft and a case or a crank chamber, via oil return piping 10, and in this embodiment, a valve 11 for opening and closing (i.e., a shut-off valve) the oil return piping 10 is provided.

The pressure of the vapor-phase coolant from which the oil is separated by the oil separator 4 is reduced to an intermediate pressure Pm by the orifice tube 5 as the first means for expansion (c–d). This intermediate pressure Pm is a specific level of pressure within the coolant vapor-liquid mix range, and the coolant to be sent out to the vapor-liquid separator 6 is in a state which the vapor phase coolant and the liquid phase coolant are mixed together. Then, the coolant, which is a vapor phase and liquid phase mixed substance, is separated into a vapor-phase coolant and liquid-phase coolant by the vapor-liquid separator 6, and the separated vapor-phase coolant directly returns to the to the intake side of the compressor 2 via vapor-phase coolant return piping 12. Thus, since the vapor-phase coolant which does not greatly affect the endothermic effect achieved in the evaporator 8 bypasses the evaporator 8 and is directly returned to the intake side of the compressor 2, an improvement is achieved in the heat exchanging efficiency in the evaporator 8, and because the unnecessary expenditure of energy for compressing the vapor-phase coolant is eliminated, the efficiency of the cycle may be improved.

Then, the liquid-phase coolant separated by the vapor-liquid separator 6 is delivered to the automatic expansion valve 7 as the second means for expansion, and its pressure is reduced to a low level Ps (d–e). The automatic expansion valve 7, which is the type specifically referred to as a temperature-actuated expansion valve, is provided with a temperature sensing tube 9 placed in contact with piping in a discharge side of the evaporator 8, so that the degree of openness of the automatic expansion valve 7 is adjusted by that coolant sealed inside the temperature sensing tube 9 expanding or contracting as the temperature on an outlet side of the evaporator 8 fluctuates, and the quantity of the coolant passing inside the evaporator 8 and the low pressure Ps of the coolant is changed so as to maintain a temperature (a degree of superheat) on the outlet side of the evaporator 8 (f–a) constantly. Consequently, it becomes possible to respond to any abrupt changes in the load attributable to external factors.

The liquid-phase coolant expanded at the automatic expansion valve 7 absorbs heat from air passing through the evaporator 8 and evaporates to become a vapor-phase coolant to be taken into the compressor 2 (e–a). Through the process described above, a refrigerating cycle such that heat is absorbed at the evaporator 8 and the heat is discharged at the radiator 3 is completed.

The following is an explanation of other embodiments of the present invention, and the same reference numbers are assigned to identical members and members having identical functions to preclude the necessity for repeated explanation thereof.

Figure 2:
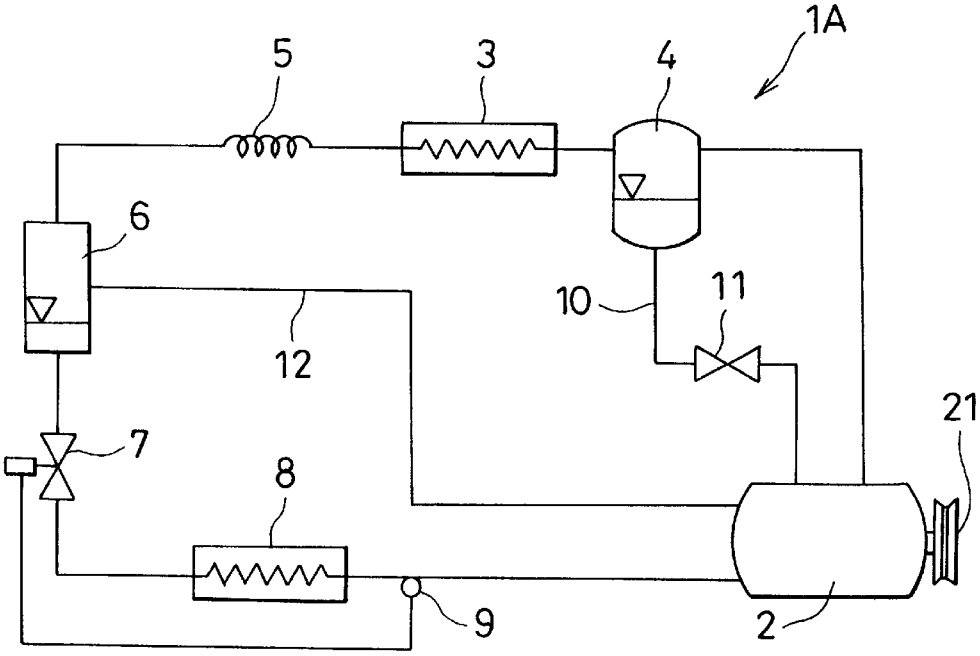
FIG. 2 is a schematic block diagram of the refrigerating cycle in a second embodiment of the present invention.

A refrigerating cycle 1A in the second embodiment illustrated in FIG. 2 is characterized in that the oil separator 4 is provided on an upstream side of the radiator 3. Thus, since the oil component is removed from the vapor-phase coolant before passing through the radiator 3, the coolant heat exchanging capability at the radiator 3 is improved.

Figure 3:
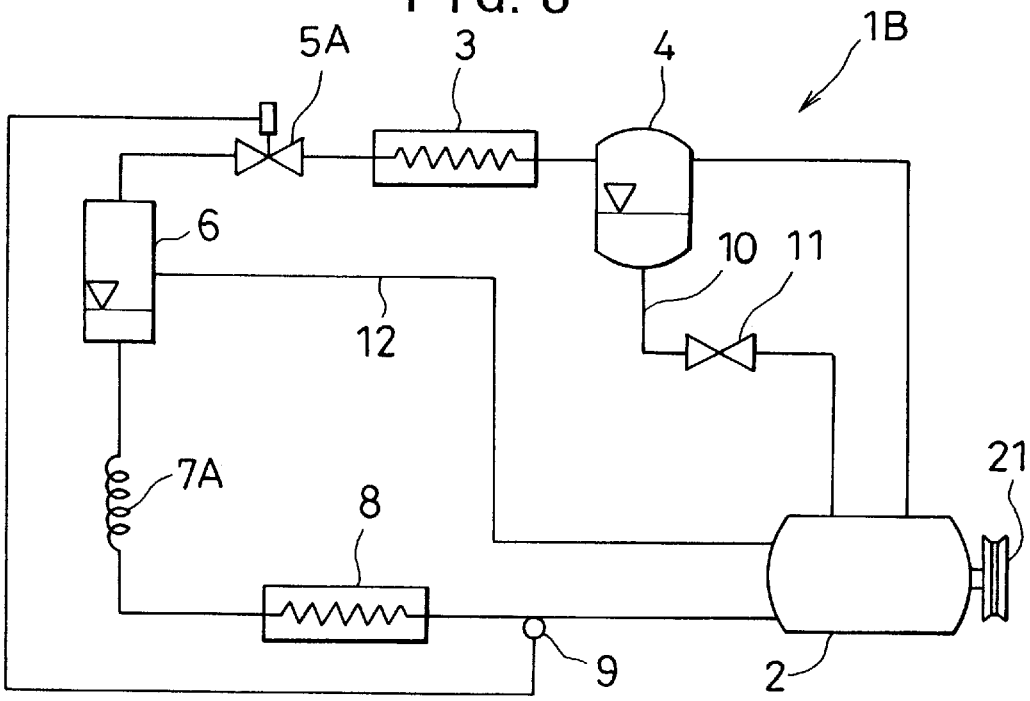
FIG. 3 is a schematic block diagram of the refrigerating cycle in a third embodiment of the present invention.

In a refrigerating cycle 1B in the third embodiment illustrated in FIG. 3, the first means for expansion is an automatic expansion valve 5A provided with a heat sensing tube 9 for detecting temperature on an outlet side of the evaporator 8 and the second means for expansion is an orifice tube 7A functioning as a fixed constrictor. In this structure, the temperature on the outlet side of the evaporator 8 is used to adjust the automatic expansion valve 5A as the first means for expansion, so that adjustment of the intermediate pressure Pm is achieved.

Figure 4:
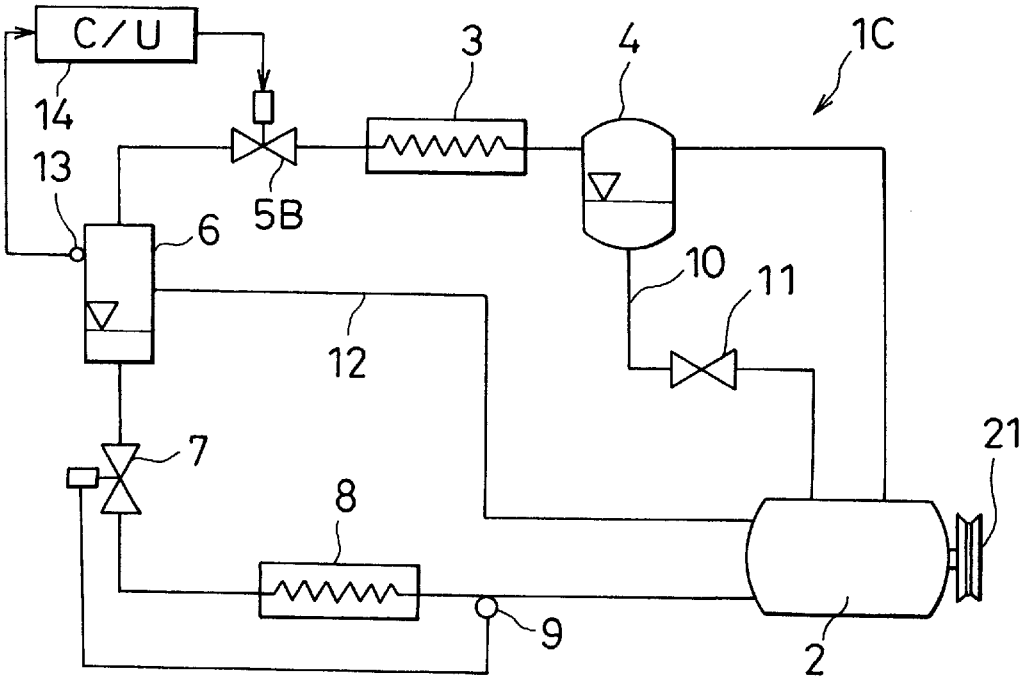
FIG.4 is a schematic block diagram of the refrigerating cycle in a fourth embodiment of the present invention.

In a refrigerating cycle 1C in the fourth embodiment illustrated in FIG. 4, an electrically-controlled expansion valve 5B (e.g., an electromagnetic expansion valve, an expansion valve adopting the actuator drive system or the like) controlled by a control unit (C/U) 14 is provided to constitute the first means for expansion. In the fourth embodiment, for detecting the intermediate pressure Pm, a sensor 13 such as a thermosensor for detecting temperature inside the vapor-liquid separator 6 or a pressure sensor directly to detect the intermediate pressure Pm is provided in the vapor-liquid separator 6, and the signal detected by the sensor 13 is input to the control unit (C/U) 14, where it undergoes arithmetic processing in conformance to a specific program, so that the expansion valve 5B is driven to achieve the correct intermediate pressure Pm. While this embodiment requires a higher production cost compared to the embodiments explained earlier, it achieves even finer control.

Figure 5:
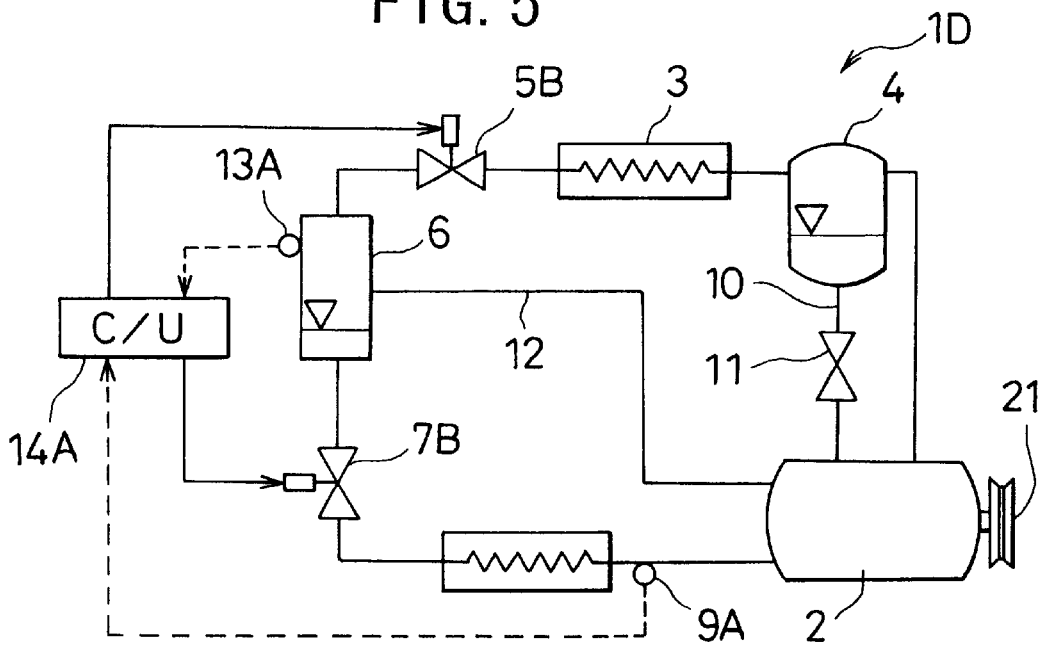
FIG. 5 is a schematic block diagram of the refrigerating cycle in a fifth embodiment of the present invention.

In a refrigerating cycle ID in the fifth embodiment illustrated in FIG. 5, which is. provided with a sensor 13A (identical to the sensor 13 explained above) for detecting the intermediate pressure Pm at the vapor-liquid separator 6 and a sensor 9A for detecting the temperature on an outlet side of the evaporator 8, signals from the sensors 9A and 13A are input to a control unit (C/U) 14A, where they undergo arithmetic processing and are output as control signals to an electrically-controlled expansion valve 5B as the first means for expansion and an electrically-controlled expansion valve 7B as the second means for expansion. Thus, the appropriate intermediate pressure Pm and the desired low pressure Ps may be gained.

Figure 6:
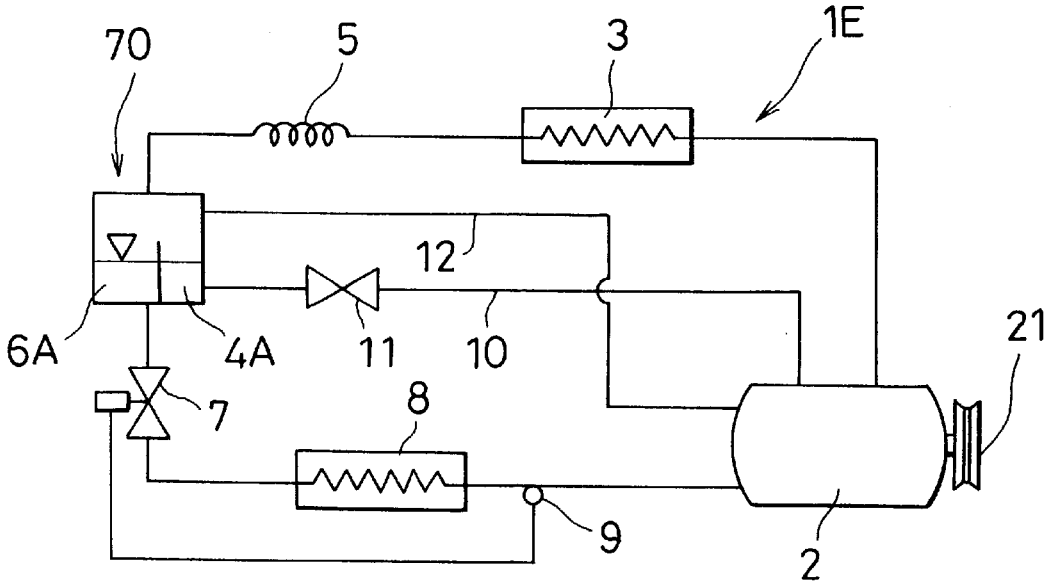
FIG. 6 is a schematic block diagram of the refrigerating cycle in a sixth embodiment of the present invention.

A refrigerating cycle 1E in the sixth embodiment illustrated in FIG. 6 is provided with a three-phase separator 70 integrating an oil separator 4A and a vapor-liquid separator 6A between the orifice tube 5 as the first means for expansion and the automatic expansion valve 7 as the second means for expansion. While it is necessary to specially provide the three-phase separator 70 in this embodiment, the structure of the refrigerating cycle can be simplified while still achieving advantages similar to those achieved in the embodiments explained earlier.

Figure 7:
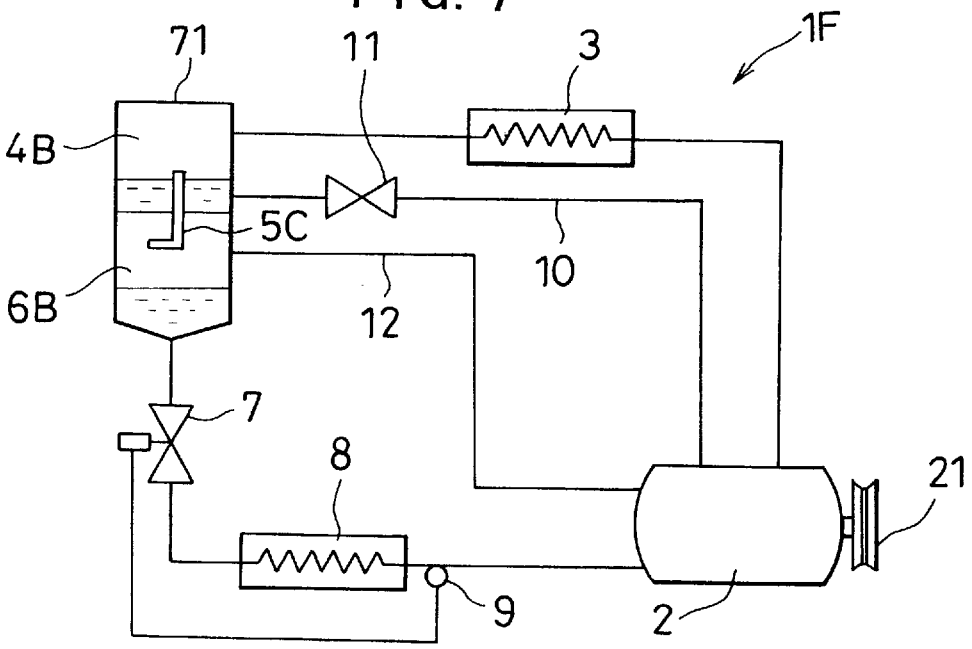
FIG. 7 is a schematic block diagram of the refrigerating cycle in a seventh embodiment of the present invention.
Figure 8:
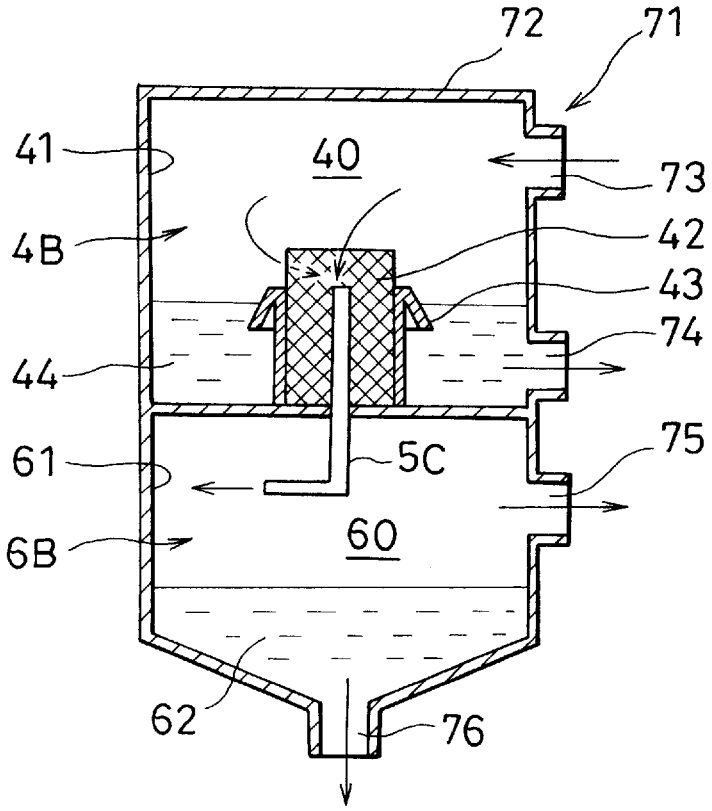
FIG. 8 is a schematic block diagram of the three-phase separator employed in the seventh embodiment.

A refrigerating cycle 1F in the seventh embodiment illustrated in FIG. 7 is provided with a three-phase separator 71 integrating an oil separator 4B, a first means for expansion 5C and a vapor-liquid separator 6B. In this three-phase separator 71 which may be structured as illustrated in FIG. 8, for instance, the oil separator 4B and the vapor-liquid separator 6B are formed inside a case housing 72 and the oil separator 4B and the vapor-liquid separator 6B are communicated with each other by an orifice 5C as the first means for expansion.

The oil separator 4B is provided with an oil separation space 40 communicating with a coolant induction port 73 and coolant induced into the oil separation space 40 collides against an inner wall portion 41 facing opposite the coolant induction port 73 to separate oil and further oil is separated by passing through an oil separation filter 42. Thus, the oil separated by colliding against the inner wall portion 41 drips into an oil reservoir 44 along the inner wall portion 41, and the oil separated by the oil separation filter 42 drips down into the oil reservoir 44 via an oil guide 43. The oil collected in the oil reservoir 44 is returned to the compressor 2 via the oil return piping 10 connected to an oil delivery port 74.

In addition, the coolant reaching a vapor-liquid separation space 60 of the vapor-liquid separator 6B from the oil separation space 40 via the orifice 5C, whose pressure is reduced to the intermediate level Pm by the orifice 5C until it achieves a mixed state in which a vapor-phase coolant and a liquid-phase coolant are mixed together, is discharged from the orifice 5C to collide against an inner wall portion 61 of the vapor-liquid separation space 60, and the liquid-phase coolant drips down into a liquid reservoir 62 in a lower portion of the vapor-liquid separation space 60. Thus, the vapor-phase coolant is returned to the compressor 2 via the vapor-phase coolant return piping 12 connected to a vapor-phase coolant delivery port 75 and the liquid coolant is delivered to the automatic expansion valve 7 as the second means for expansion connected to a liquid-phase coolant delivery port 76. Thus, an added advantage of simplification in the circuit structure is achieved while still achieving advantages similar to those achieved in the embodiments explained earlier.

Furthermore, a vapor-liquid separation filter may be provided inside the vapor-liquid separation space 60 to further promote vapor-liquid separation, or an electrically-controlled expansion valve may be provided in place of the orifice.5C in the seventh embodiment.

As has been explained, according to the present invention, the first means for expansion is employed to reduce the pressure of the coolant to an intermediate pressure in a vapor-liquid mix range and only the liquid-phase coolant obtained through the process of vapor-liquid separation is delivered to the second means for expansion and the evaporator, so that the heat exchanging efficiency at the evaporator is improved, as a result, an improvement is achieved in the refrigerating efficiency in the refrigerating cycle utilizing a supercritical coolant. Thus, since the heat exchanging efficiency in a cycle utilizing a supercritical coolant such as carbon dioxide as an alternative to Freon can be improved in a simple structure, an environment-friendly and efficient refrigerating cycle is achieved.

In addition, since the control of the degree of superheat is achieved by the first and/or second means for expansion according to the present invention, quick response can be achieved to any fluctuation in the cooling load resulting from changes in the environment and/or the operating state, which makes for a refrigerating cycle ideal for application in air conditioning systems for vehicles.

Although the invention has been described in its preferred form 20 with a certain degree of particularity, it is understood that the present disclosure of the preferred form may be changed in the details of construction and in the combination and arrangement of parts without departing from the spirit and scope of the invention as hereinafter claimed.

What is claimed is:

1. A refrigerating cycle comprising:

a compressor for compressing a vapor-phase coolant to a supercritical range;

a radiator for radiating heat from the vapor-phase coolant discharged in the supercritical range from said compressor;

an oil separator that separates oil from the vapor-phase coolant;

a first expansion device that lowers pressure of the vapor-phase coolant to a vapor-liquid two-phase range;

a vapor-liquid separator that separates the coolant in the vapor-liquid two-phase range from said first expansion device into a vapor-phase coolant to be returned to said compressor and a liquid-phase coolant;

a second expansion device disposed such that said vapor-liquid separator is between said first and second expansion devices, said second expansion device being operable to lower pressure of the liquid-phase coolant from said vapor-liquid separator;

an evaporator that evaporates the liquid-phase coolant whose pressure has been lowered by said second expansion device;

oil return piping communicating between said oil separator and said compressor; and a shut-off valve operable to open and close said oil return piping.

2. A refrigerating cycle according to claim 1, wherein said oil separator and said vapor-liquid separator are integral as a single three-phase separator, said three-phase separator being provided between said first expansion device and said second expansion device.

3. A refrigerating cycle according to claim 1, wherein said oil separator and said first expansion device are arranged such that said oil separator separates oil from the vapor-phase coolant in the supercritical range to thereby provide any remaining vapor-phase coolant for said first expansion device.

4. A refrigerating cycle according to claim 3, wherein said oil separator, said vapor-liquid separator, and said first expansion device are integral as a single three-phase separator, said three-phase separator being provided between said radiator and said second expansion device.

5. A refrigerating cycle according to claim 1, wherein said oil separator and said radiator are arranged such that said oil separator separates oil from the vapor-phase coolant in the supercritical range to thereby provide any remaining vapor-phase coolant for said radiator.

6. A refrigerating cycle according to claim 1, wherein said oil separator, said compressor, and said oil return piping are arranged so as to enable direct communication between said oil separator and said compressor by way of said oil return piping.

7. A refrigerating cycle according to claim 1, wherein:

said first expansion device comprises an orifice tube; and said second expansion device comprises an automatic expansion valve which is controlled so as to maintain a degree of superheat thereof constantly.

8. A refrigerating cycle according to claim 2, wherein:

said first expansion device comprises an orifice tube; and said second expansion device comprises an automatic expansion valve which is controlled so as to maintain a degree of superheat thereof constantly.

9. A refrigerating cycle according to claim 4, wherein:

said first expansion device comprises an orifice tube; and said second expansion device comprises an automatic expansion valve which is controlled so as to maintain a degree of superheat thereof constantly.

10. A refrigerating cycle according to claim 5, wherein:

said first expansion device comprises an orifice tube; and said second expansion device comprises an automatic expansion valve which is controlled so as to maintain a degree of superheat thereof constantly.

11. A refrigerating cycle according to claim 1, wherein:

said first expansion device comprises an automatic expansion valve which is controlled so as to maintain a degree of superheat thereof constantly; and said second expansion device comprises an orifice tube.

12. A refrigerating cycle according to claim 2, wherein:

said first expansion device comprises an automatic expansion valve which is controlled so as to maintain a degree of superheat thereof constantly; and said second expansion device comprises an orifice tube.

13. A refrigerating cycle according to claim 4, wherein:

said first expansion device comprises an automatic expansion valve which is controlled so as to maintain a degree of superheat thereof constantly; and said second expansion device comprises an orifice tube.

14. A refrigerating cycle according to claim 5, wherein:

said first expansion device comprises an automatic expansion valve which is controlled so as to maintain a degree of superheat thereof constantly; and said second expansion device comprises an orifice tube.

15. A refrigerating cycle according to claim 1, wherein:

said first expansion device comprises an electrically-controlled expansion valve which is controlled by an external signal; and said second expansion device comprises an automatic expansion valve which is controlled so as to maintain a degree of superheat thereof constantly.

16. A refrigerating cycle according to claim 2, wherein:

said first expansion device comprises an electrically-controlled expansion valve which is controlled by an external signal; and said second expansion device comprises an automatic expansion valve which is controlled so as to maintain a degree of superheat thereof constantly.

17. A refrigerating cycle according to claim 4, wherein:

said first expansion device comprises an electrically-controlled expansion valve which is controlled by an external signal; and said second expansion device comprises an automatic expansion valve which is controlled so as to maintain a degree of superheat thereof constantly.

18. A refrigerating cycle according to claim 5, wherein:

said first expansion device comprises an electrically-controlled expansion valve which is controlled by an external signal; and said second expansion device comprises an automatic expansion valve which is controlled so as to maintain a degree of superheat thereof constantly.

19. A refrigerating cycle according to claim 1, wherein both said first expansion device and said second expansion device comprise an electrically-controlled expansion valve which is controlled by an external signal.

20. A refrigerating cycle according to claim 2, wherein both said first expansion device and said second expansion device comprise an electrically-controlled expansion valve which is controlled by an external signal.

21. A refrigerating cycle according to claim 4, wherein both said first expansion device and said second expansion device comprise an electrically-controlled expansion valve which is controlled by an external signal.

22. A refrigerating cycle according to claim 1, wherein said first expansion device comprises an orifice tube.

23. A refrigerating cycle according to claim 1, wherein said second expansion device comprises an automatic expansion valve which is controlled so as to maintain a degree of superheat thereof constantly.

* * * * *